US011066222B2

(12) United States Patent
Lorence

(10) Patent No.: US 11,066,222 B2
(45) Date of Patent: Jul. 20, 2021

(54) PACKAGE OPENING FEATURE

(71) Applicant: BOSTON SCIENTIFIC SCIMED, INC., Maple Grove, MN (US)

(72) Inventor: Matthew Woodard Lorence, Plymouth, MN (US)

(73) Assignee: BOSTON SCIENTIFIC SCIMED, INC., Maple Grove, MN (US)

( * ) Notice: Subject to any disclaimer, the term of this patent is extended or adjusted under 35 U.S.C. 154(b) by 756 days.

(21) Appl. No.: 15/355,044

(22) Filed: Nov. 17, 2016

(65) Prior Publication Data

US 2017/0137194 A1 May 18, 2017

Related U.S. Application Data

(60) Provisional application No. 62/256,365, filed on Nov. 17, 2015.

(51) Int. Cl.

| | |
|---|---|
| ***B65D 75/58*** | (2006.01) |
| ***B65D 5/54*** | (2006.01) |
| ***A61J 1/00*** | (2006.01) |

(52) U.S. Cl.

CPC ..... *B65D 75/5805* (2013.01); *A61J 1/00* (2013.01); *B65D 5/5425* (2013.01)

(58) Field of Classification Search

CPC ..... A61J 1/00; B65D 75/5805; B65D 5/5425; B65D 5/068; B65D 5/5445; B65D 5/54; B65D 5/067

(Continued)

(56) References Cited

U.S. PATENT DOCUMENTS 2,097,647 A * 11/1937 Scott ..... B65D 5/745 229/125.02
2,348,377 A * 5/1944 Goodyear ..... B65D 5/543 229/117.28

(Continued)

FOREIGN PATENT DOCUMENTS

CN 102481997 A 5/2012
DE 2940421 A1 4/1981

(Continued)

OTHER PUBLICATIONS

International Search Report and Written Opinion dated Jan. 18, 2017 for International Application No. PCT/US2016/062625.

*Primary Examiner* — Anthony D Stashick
*Assistant Examiner* — James M Van Buskirk
(74) *Attorney, Agent, or Firm* — Seager, Tufte & Wickhem, LLP

(57) ABSTRACT

A package may include a front panel and a back panel opposite the front panel, each including a top end and a bottom end, and a first side panel and a second side panel each extending between the front panel and the back panel. The front panel includes a front panel perforation extending from the first side panel to the second side panel. The back panel includes a back panel perforation extending from the first side panel to the second side panel. The front panel perforation and the back panel perforation may be disposed between the top and bottom ends of the front and back panels, respectively. The first side panel includes a first side panel perforation extending from the front panel perforation to the back panel perforation. The second side panel includes a hinge element extending from the front panel perforation to the back panel perforation.

16 Claims, 6 Drawing Sheets

(58) Field of Classification Search
USPC ..... 206/438, 353; 229/122, 229, 183
See application file for complete search history.

(56) References Cited

U.S. PATENT DOCUMENTS

| | | | | |
|---|---|---|---|---|
| 2,654,525 | A * | 10/1953 | Adorney | B65D 5/541 229/215 |
| 3,207,416 | A * | 9/1965 | Koltz | B65D 5/543 229/102 |
| 3,543,998 | A | 12/1970 | Dunlap | |
| 3,599,858 | A | 8/1971 | Samsing | |
| 4,753,384 | A | 6/1988 | Focke et al. | |
| 5,622,309 | A | 4/1997 | Matsuda et al. | |
| 5,653,384 | A | 8/1997 | Shaikh | |
| 5,957,280 | A | 9/1999 | Focke et al. | |
| 6,510,982 | B2 | 1/2003 | White et al. | |
| 6,715,605 | B1 | 4/2004 | Manservigi et al. | |
| 6,789,673 | B2 | 9/2004 | Lingamfelter | |
| 7,320,399 | B2 | 1/2008 | Ghini et al. | |
| 7,328,798 | B2 | 2/2008 | Auclair et al. | |
| 7,357,254 | B2 | 4/2008 | Auclair et al. | |
| 7,475,777 | B2 | 1/2009 | Fung et al. | |
| 7,712,653 | B2 | 5/2010 | DeBusk et al. | |
| D618,090 | S | 6/2010 | Tearle | |
| 7,845,490 | B2 | 12/2010 | Moore et al. | |
| 8,011,501 | B2 | 9/2011 | Biondi et al. | |
| 8,281,979 | B1 | 10/2012 | Pfanstiehl | |
| 8,342,335 | B2 | 1/2013 | Couture | |
| 8,376,141 | B2 | 2/2013 | Couture | |
| 2004/0089671 | A1 | 5/2004 | Miller | |
| 2005/0103650 | A1 | 5/2005 | Auclair et al. | |
| 2005/0126947 | A1 | 6/2005 | Holley, Jr. | |
| 2006/0249414 | A1 | 11/2006 | Holley, Jr. | |
| 2010/0122998 | A1 | 5/2010 | Burke | |
| 2016/0340099 | A1 * | 11/2016 | Scharfenort | B65D 5/745 |

FOREIGN PATENT DOCUMENTS

| | | | |
|---|---|---|---|
| DE | 9316489 | U1 | 1/1994 |
| DE | 4242780 | A1 | 6/1994 |
| EP | 1986933 | B1 | 11/2013 |
| FR | 2197774 | A1 | 3/1974 |
| GB | 466947 | A | 6/1937 |
| JP | 52017238 | U1 | 2/1977 |
| JP | 61022771 | U1 | 2/1986 |
| NL | 7412366 | A | 3/1975 |
| WO | 2005051777 | A2 | 6/2005 |

* cited by examiner

PACKAGE OPENING FEATURE

CROSS-REFERENCE TO RELATED APPLICATIONS

This application claims the benefit of priority under 35 U.S.C. § 119 to U.S. Provisional Application No. 62/256,365, filed Nov. 17, 2015, the entirety of which is incorporated herein by reference.

TECHNICAL FIELD

The disclosure relates generally to product packaging and in particular to an opening feature for product packaging.

BACKGROUND

Product packaging may frequently include a three-dimensional carton. In some cases, the carton may include end flaps and/or a locking tab that is inserted through a slit or notch in an end flap to secure the end flap in place. Some product packaging may also include a closure strip or other apparatus for securing the end flap. Opening a product package may sometimes involve multiple steps and/or may create loose and/or unwanted waste elements. A continuing need exists for package features that improve package opening efficiency, reduce cost, and/or provide other benefits.

SUMMARY

In a first aspect, a package for a medical device may include a front panel and a back panel opposite the front panel, the front panel and the back panel each including a top end and a bottom end. The package includes a first side panel extending between the front panel and the back panel, and a second side panel extending between the front panel and the back panel opposite the first side panel. The front panel includes a front panel perforation extending from the first side panel to the second side panel, the front panel perforation being disposed between the top end of the front panel and the bottom end of the front panel. The back panel includes a back panel perforation extending from the first side panel to the second side panel, the back panel perforation being disposed between the top end of the back panel and the bottom end of the back panel. The first side panel includes a first side panel perforation extending from the front panel perforation to the back panel perforation. The second side panel includes a hinge element extending from the front panel perforation to the back panel perforation.

In addition or alternatively, and in a second aspect, the back panel perforation is substantially parallel with the front panel perforation.

In addition or alternatively, and in a third aspect, the hinge element includes a score line formed in the second side panel.

In addition or alternatively, and in a fourth aspect, the first side panel includes a first weakened bend element extending from the first side panel perforation toward a top end of the first side panel.

In addition or alternatively, and in a fifth aspect, the first weakened bend element extends substantially perpendicular to the first side panel perforation.

In addition or alternatively, and in a sixth aspect, the first weakened bend element includes a score line formed in the first side panel.

In addition or alternatively, and in a seventh aspect, displacement of the front panel toward the back panel adjacent the top ends thereof bends the first side panel at the first weakened bend element.

In addition or alternatively, and in an eighth aspect, displacement of the front panel toward the back panel adjacent the top ends thereof initiates tearing of the first side panel at the first side panel perforation.

In addition or alternatively, and in a ninth aspect, moving the top end of the front panel and the top end of the back panel away from the bottom end of the front panel and the bottom end of the back panel adjacent the first side panel tears the front panel at the front panel perforation and tears the back panel at the back panel perforation.

In addition or alternatively, and in a tenth aspect, a method of opening a package for a medical device may include grasping a top portion of the package with a first hand and a bottom portion of the package with a second hand, the package comprising a front panel and a back panel opposite the front panel, the front panel and the back panel each including a top end and a bottom end; a first side panel extending between the front panel and the back panel; and a second side panel extending between the front panel and the back panel opposite the first side panel. The front panel includes a front panel perforation extending from the first side panel to the second side panel and the back panel includes a back panel perforation extending from the first side panel to the second side panel. The first side panel includes a first side panel perforation extending from the front panel perforation to the back panel perforation. The second side panel includes a hinge element extending from the front panel perforation to the back panel perforation. The method may include squeezing the top portion of the package adjacent the front panel perforation and the back panel perforation with the first hand, thereby initiating separation of the top portion from the bottom portion adjacent the first side panel. The method may include pulling the top portion of the package away from the bottom portion of the package to tear the front panel perforation and the back panel perforation from the first side panel to the second side panel. The method may include rotating the top portion at the hinge element with the first hand.

In addition or alternatively, and in an eleventh aspect, the method may include releasing the top portion with the first hand while continuing to grasp the bottom portion with the second hand, and removing the medical device from within the package using the first hand.

In addition or alternatively, and in a twelfth aspect, the front panel perforation is disposed between the top end of the front panel and the bottom end of the front panel. The back panel perforation is disposed between the top end of the back panel and the bottom end of the back panel.

In addition or alternatively, and in a thirteenth aspect, squeezing the top portion of the package bends the first side panel at a first weakened bend element disposed between the front panel and the back panel.

In addition or alternatively, and in a fourteenth aspect, squeezing the top portion of the package tears the front panel perforation and the back panel perforation adjacent the first side panel.

In addition or alternatively, and in a fifteenth aspect, the top portion of the package and the bottom portion of the package are separated by the front panel perforation and the back panel perforation.

In addition or alternatively, and in a sixteenth aspect, the top portion of the package extends away from the top end of the front panel and the top end of the back panel, and towards the bottom end of the front panel and the bottom end of the back panel.

In addition or alternatively, and in a seventeenth aspect, the grasping, squeezing, pulling, and rotating steps occur in one continuous motion.

In addition or alternatively, and in an eighteenth aspect, the squeezing, pulling, and rotating steps occur without removing the first hand or the second hand from the package.

In addition or alternatively, and in a nineteenth aspect, grasping the bottom portion of the package includes pinching the medical device between the front panel and the back panel with the second hand.

In addition or alternatively, and in a twentieth aspect, a package may comprise a front panel and a back panel opposite the front panel, the front panel and the back panel each including a top end and a bottom end, a first side panel extending between the front panel and the back panel, and a second side panel extending between the front panel and the back panel opposite the first side panel. The front panel may include a means for propagating a controlled tear in the front panel extending from the first side panel to the second side panel, the means for propagating a controlled tear in the front panel being disposed between the top end of the front panel and the bottom end of the front panel. The back panel may include a means for propagating a controlled tear in the back panel extending from the first side panel to the second side panel, the means for propagating a controlled tear in the back panel being disposed between the top end of the back panel and the bottom end of the back panel. The first side panel may include a means for propagating a controlled tear in the first side panel extending from the means for propagating a controlled tear in the front panel to the means for propagating a controlled tear in the back panel. The second side panel may include a flexing portion extending from the means for propagating a controlled tear in the front panel to the means for propagating a controlled tear in the back panel.

The above summary of some embodiments, aspects, and/or examples is not intended to describe each disclosed embodiment or every implementation of the present disclosure. The Figures, and Detailed Description, which follow, more particularly exemplify these embodiments.

Figure 1:
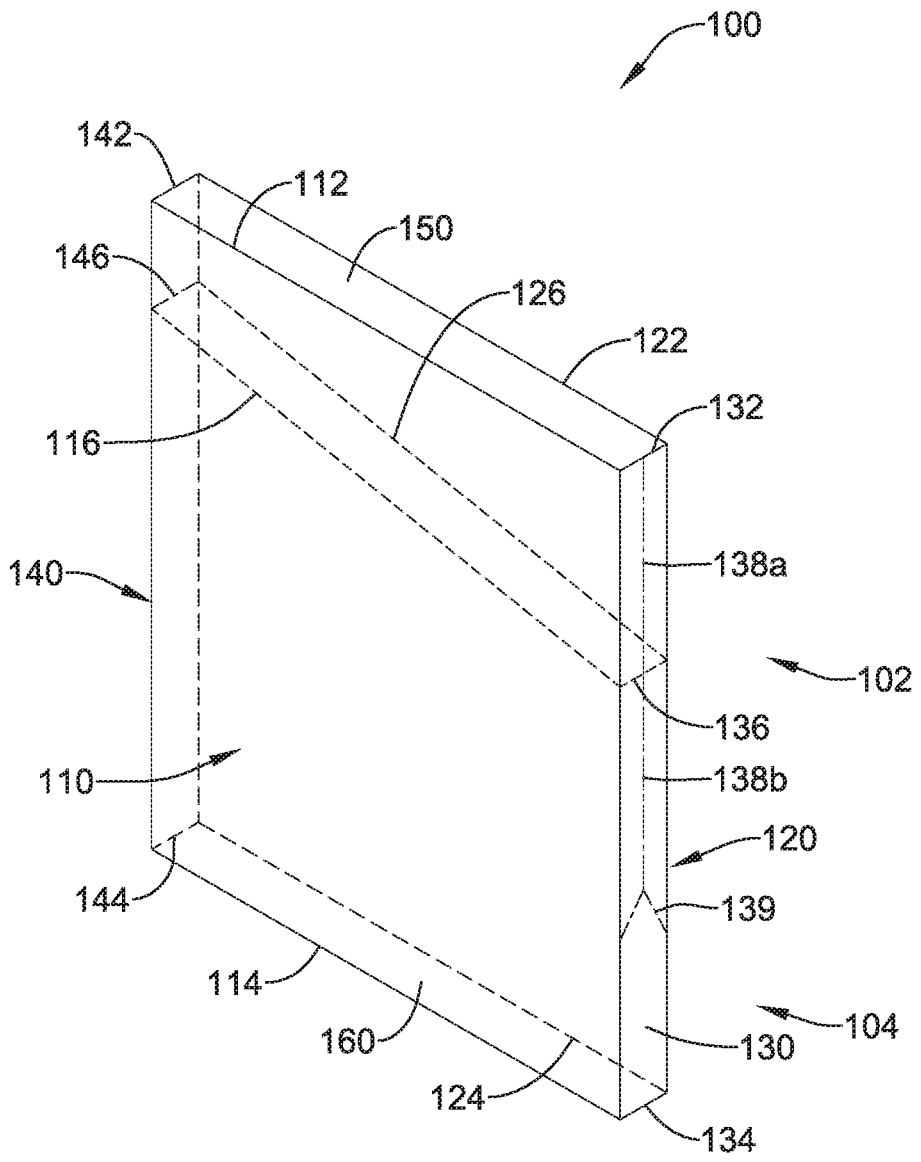
FIG. 1 is a perspective view of an example package.

While aspects of the disclosure are amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DETAILED DESCRIPTION

The following description should be read with reference to the drawings, which are not necessarily to scale, wherein like reference numerals indicate like elements throughout the several views. The detailed description and drawings are intended to illustrate but not limit the claimed invention. Those skilled in the art will recognize that the various elements described and/or shown may be arranged in various combinations and configurations without departing from the scope of the disclosure. The detailed description and drawings illustrate example embodiments of the claimed invention.

Generally speaking, in terms of the orientation of the structural elements relative to each other and the operation of the disclosed device(s), a proximal end may be considered closest to the user (or external to a patient) and a distal end farthest from the user (or internal to a patient). However, the skilled artisan will appreciate that the orientations and/or directions may be reversed as necessary or appropriate.

For the following defined terms, these definitions shall be applied, unless a different definition is given in the claims or elsewhere in this specification.

All numeric values are herein assumed to be modified by the term "about," whether or not explicitly indicated. The term "about", in the context of numeric values, generally refers to a range of numbers that one of skill in the art would consider equivalent to the recited value (i.e., having the same function or result). In many instances, the term "about" may include numbers that are rounded to the nearest significant figure. Other uses of the term "about" (i.e., in a context other than numeric values) may be assumed to have their ordinary and customary definition(s), as understood from and consistent with the context of the specification, unless otherwise specified.

The recitation of numerical ranges by endpoints includes all numbers within that range, including the endpoints (e.g. 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

Relative terms such as "proximal", "distal", "advance", "retract", variants thereof, and the like, may be generally be considered with respect to the positioning, direction, and/or operation of various elements relative to a user/operator/manipulator of the device, wherein "proximal" and "retract" indicate or refer to closer to or toward the user and "distal" and "advance" indicate or refer to farther from or away from the user.

In some embodiments, a "perforation" may be considered to include one or more of the following arrangements: a series or a line of small holes or discontinuous cuts extending at least partially or completely through a material or a surface of a material; a "reverse cut" comprising a series or a line of discontinuous cuts extending partially through a material from an inside or non-visible surface; two parallel series or lines of discontinuous cuts partially through a material from opposite sides or surfaces of the material, the cuts being offset by a small distance to facilitate delamination of the plies of the material; a tear strip or tape disposed along a desired tear line; and/or other suitable means of propagating a controlled tear known in the art.

It is noted that references in the specification to "an embodiment", "some embodiments", "other embodiments", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of one skilled in the art to effect such feature, structure, or characteristic in connection with other embodiments, whether or not explicitly described, unless clearly stated to the contrary. That is, the various individual elements described below, even if not explicitly shown in a particular combination, are nevertheless contemplated as being combinable or arrangable with each other to form other additional embodiments or to complement and/or enrich the described embodiment(s), as would be understood by one of ordinary skill in the art.

For the purpose of clarity, certain identifying numerical nomenclature (e.g., first, second, third, fourth, etc.) may be used throughout the description and/or claims to name and/or differentiate between various described and/or claimed features. It is to be understood that the numerical nomenclature is not intended to be limiting and is exemplary only. In some embodiments, alterations of and deviations from previously-used numerical nomenclature may be made in the interest of brevity and clarity. That is, a feature identified as a "first" element may later be referred to as a "second" element, a "third" element, etc. or may be omitted entirely, and/or a different feature may be referred to as the "first" element. The meaning and/or designation in each instance will be apparent to the skilled practitioner.

Some product packaging may be opened during a process or procedure that directly and/or immediately uses the product disposed therein. For example, a package for a medical device may be opened during the medical procedure that utilizes the medical device. Some product packaging involves folded flaps and/or adhesive strips that must be opened and/or removed before the product (e.g., medical device) therein may be accessed. In some instances, opening the flaps and/or removing the strips may be time consuming and/or may create waste elements. In some cases, the waste elements may be "loose" or unattached to the package after opening the package. Disclosed herein are packages and methods having improved opening features that may reduce the time required to open the package, reduce the effort required to open the package, and/or reduce waste elements created by opening the package, thereby providing an improved user experience during opening of the package. The packages and/or methods disclosed herein may also provide a number of additional desirable features and benefits as described in more detail below.

FIG. 1 schematically illustrates an example package 100 such as a three-dimensional carton or box, as may be used to hold and/or retain a product (e.g., a medical device, etc.) during shipment and/or storage. In some embodiments, the package 100 may include a front panel 110 and a back panel 120 opposite the front panel 110. The front panel 110 may include a top end 112 and a bottom end 114. The back panel 120 may include a top end 122 and a bottom end 124. In some embodiments, the package 100 may include a first side panel 130 extending between the front panel 110 and the back panel 120. The first side panel 130 may include a top end 132 and a bottom end 134. In some embodiments, the package 100 may include a second side panel 140 extending between the front panel 110 and the back panel 120 opposite the first side panel 130. The second side panel 140 may include a top end 142 and a bottom end 144. While the example package 100 is shown illustratively as having four sides or panels (e.g., front panel 110, back panel 120, first side panel 130, second side panel 140) and two ends or panels (e.g., top panel 150, bottom panel 160, described below), other configurations are also contemplated—such as, but not limited to, three sides, five sides, six sides, eight sides, ten sides, etc.

In some embodiments, the package 100 may include a top panel 150 and a bottom panel 160 opposite the top panel 150. In some embodiments, the top end 112 of the front panel 110, the top end 122 of the back panel 120, the top end 132 of the first side panel 130, and the top end 142 of the second side panel 140 may each be disposed at and/or adjacent to each other, the top panel 150, and/or a top portion 102 of the package 100. In some embodiments, the top portion 102 may include a top portion of the front panel 110, a top portion of the back panel 120, a top portion of the first side panel 130, and/or a top portion of the second side panel 140. In some embodiments, the bottom end 114 of the front panel 110, the bottom end 124 of the back panel 120, the bottom end 134 of the first side panel 130, and the bottom end 144 of the second side panel 140 may each be disposed at and/or adjacent to each other, the bottom panel 160, and/or a bottom portion 104 of the package 100. In some embodiments, the bottom portion 104 may include a bottom portion of the front panel 110, a bottom portion of the back panel 120, a bottom portion of the first side panel 130, and/or a bottom portion of the second side panel 140. In some embodiments, the top panel 150 may be immediately adjacent to and/or pivotably attached at the top end 112 of the front panel 110, the top end 122 of the back panel 120, the top end 132 of the first side panel 130, and/or the top end 142 of the second side panel 140. In some embodiments, the bottom panel 160 may be immediately adjacent to and/or pivotably attached at the bottom end 114 of the front panel 110, the bottom end 124 of the back panel 120, the bottom end 134 of the first side panel 130, and/or the bottom end 144 of the second side panel 140.

In some embodiments, the top panel 150 and/or the bottom panel 160 may include a tuck flap having folds and/or bends and a latch portion that is inserted within the package 100, thereby rendering the top panel 150 and/or the bottom panel 160 reversibly closable. In some embodiments, the top panel 150 and/or the bottom panel 160 may include a plurality of individual flaps, for example one individual flap pivotably attached at and/or to some or all of the respective top ends or bottom ends of the front panel 110, the back panel 120, the first side panel 130, and/or the second side panel 140. In some embodiments, two or more of the plurality of individual flaps may be fixedly attached and/or secured to each other, using an adhesive material for example. In some embodiments, the top panel 150 and/or the bottom panel 160 may be integrally or unitarily formed with the package 100, the front panel 110, the back panel 120, the first side panel 130, and/or the second side panel 140. In some embodiments, the top panel 150 and/or the bottom panel 160 may be formed as a separate element and later joined to the package 100, the front panel 110, the back panel 120, the first side panel 130, and/or the second side panel 140, using adhesive(s), mechanical fastening means, or other attachment means known to the skilled artisan.

In some embodiments, the front panel 110 may include a front panel perforation 116. In some embodiments, the front panel perforation 116 may extend from the first side panel 130 to the second side panel 140. In some embodiments, the front panel perforation 116 may extend across an entire width of the front panel 110, thereby separating the front panel 110 into a top portion and a bottom portion. In some embodiments, the front panel perforation 116 may extend substantially straight across the width of the front panel 110, such as parallel to or angled relative to the top end 112 of the front panel 110 and/or the bottom end 114 of the front panel 110. In some embodiments, the front panel perforation 116 may extend across the width of the front panel 110 in a curve or irregular line. In some embodiments, the front panel perforation 116 may be disposed between the top end 112 of the front panel 110 and the bottom end 114 of the front panel 110. In at least some embodiments, the front panel perforation 116 is not disposed along a joint or bend between the front panel 110 and the top panel 150 and/or the bottom panel 160.

In some embodiments, the back panel 120 may include a back panel perforation 126. In some embodiments, the back panel perforation 126 may extend from the first side panel 130 to the second side panel 140. In some embodiments, the back panel perforation 126 may extend across an entire width of the back panel 120, thereby separating the back panel 120 into a top portion and a bottom portion. In some embodiments, the back panel perforation 126 may extend substantially straight across the width of the back panel 120, such as parallel to or angled relative to the top end 122 of the back panel 120 and/or the bottom end 124 of the back panel 120. In some embodiments, the back panel perforation 126 may extend across the width of the back panel 120 in a curve or irregular line. In some embodiments, the back panel perforation 126 may be oriented substantially parallel with the front panel perforation 116. In some embodiments, the back panel perforation 126 may be disposed between the top end 122 of the back panel 120 and the bottom end 124 of the back panel 120. In at least some embodiments, the back panel perforation 126 is not disposed along a joint or bend between the back panel 120 and the top panel 150 and/or the bottom panel 160.

In some embodiments, the first side panel 130 may include a first side panel perforation 136. In some embodiments, the first side panel perforation 136 may extend from the front panel perforation 116 to the back panel perforation 126, thereby joining the front panel perforation 116 and the back panel perforation 126 to form a single, uninterrupted perforation from the second side panel 140 around the package 100 (e.g., through and/or across the front panel 110, the first side panel 130, and the back panel 120) and back to the second side panel 140. In some embodiments, the top portion 102 and the bottom portion 104 may be separated by and/or defined by the front panel perforation 116, the back panel perforation 126, the first side panel perforation 136, and/or the single, uninterrupted perforation around the package 100. In some embodiments, the first side panel perforation 136 may extend across an entire width of the first side panel 130, thereby separating the first side panel 130 into a top portion and a bottom portion. In some embodiments, the first side panel perforation 136 may extend substantially straight across the width of the first side panel 130, such as parallel to or angled relative to the top end 132 of the first side panel 130 and/or the bottom end 134 of the front side panel 130. In some embodiments, the first side panel perforation 136 may extend across the width of the first side panel 130 in a curve or irregular line. In some embodiments, the first side panel perforation 136 may be disposed between the top end 132 of the first side panel 130 and the bottom end 134 of the first side panel 130. In at least some embodiments, the first side panel perforation 136 is not disposed along a joint or bend between the first side panel 130 and the top panel 150 and/or the bottom panel 160.

In some embodiments, the first side panel 130 may include a first weakened bend element **138*a* extending from the first side panel perforation 136 toward the top end 132 of the first side panel 130. In at least some embodiments, a "weakened bend element" may permit bending and/or flexing of the adjacent portions of the package relative to each other, but in contrast to a "perforation", may not intend to permit separation of the adjacent portions of the package from each other. In some embodiments, the first side panel 130 may include a second weakened bend element 138*b* extending from the first side panel perforation 136 toward the bottom end 134 of the first side panel 130. In some embodiments, the first weakened bend element 138*a* and/or the second weakened bend element 138*b* may be disposed between the front panel 110 and the back panel 120. In some embodiments, the first weakened bend element 138*a* and/or the second weakened bend element 138*b* may extend substantially perpendicular to the first side panel perforation 136 and/or the top end 132 of the first side panel 130 and/or the top panel 150. In some embodiments, the first weakened bend element 138*a* and/or the second weakened bend element 138*b* may include and/or be formed as a score line formed and/or disposed in the first side panel 130**.

In some embodiments, the second weakened bend element **138*b* may optionally include an angled portion 139 at a bottom end thereof extending toward the front panel 110 and/or the back panel 120. Although the angled portion 139 is depicted generally in the figures as a "fork", other configurations are also contemplated. In some embodiments, the angled portion 139 may facilitate and/or permit easier bending (e.g., requiring less force to overcome the right-angle structure depicted when squeezing the bottom portion 104, for example) of the bottom portion of the first side panel 130. In some embodiments, the first weakened bend element 138*a* may optionally include an angled portion at a top end thereof (not shown) similar in structure and function to the angled portion 139**.

In some embodiments, the second side panel 140 may include a hinge element 146 extending from the front panel perforation 116 to the back panel perforation 126. In some embodiments, the hinge element 146 may be configured to facilitate bending, pivoting, hinging, and/or flexing within the second side panel 140. In some embodiments, the hinge element 146 may include and/or be formed as a score line formed and/or disposed in the second side panel 140. In some embodiments, the hinge element 146 may include and/or be formed as a joint formed and/or disposed in the second side panel 140. In some embodiments, the hinge element 146 may include and/or be formed as a flexing portion formed and/or disposed within the second side panel 140, the flexing portion being weakened and/or more easily bent than a remainder or the second side panel 140. In some embodiments, the hinge element 146 may function similarly to a "weakened bend element", and in some embodiments, the hinge element 146 may provide increased hinging action compared to a "weakened bend element". In some embodiments, the hinge element 146 may be formed and/or oriented generally parallel to the top end 142 of the second side panel 140, the top panel 150, the first side panel perforation 136, the front panel perforation 116, and/or the back panel perforation 126. In some embodiments, the hinge element 146 may extend substantially straight across the width of the second side panel 140. In some embodiments, the hinge element 146 may extend across an entire width of the second side panel 140, thereby separating the second side panel 140 into a top portion and a bottom portion. In some embodiments, the hinge element 146 may be disposed between the top end 142 of the second side panel 140 and the bottom end 144 of the second side panel 140. In at least some embodiments, the hinge element 146 is not disposed along a joint or bend between the second side panel 140 and the top panel 150 and/or the bottom panel 160.

In some embodiments, displacement of the front panel 110 toward the back panel 120 (and/or displacement of the back panel 120 toward the front panel 110) adjacent the top end 112 of the front panel 110 and the top end 122 of the back panel 120 (and/or at the top portion 102 of the package 100) may bend the first side panel 130 at the first weakened bend element 138*a*. In some embodiments, displacement of the front panel 110 toward the back panel 120 (and/or displacement of the back panel 120 toward the front panel 110) of the bottom portion 104 of the package 100 may bend the first side panel 130 at the second weakened bend element 138*b*. In some embodiments, displacement of the front panel 110 toward the back panel 120 (and/or displacement of the back panel 120 toward the front panel 110) adjacent the top end 112 of the front panel 110 and the top end 122 of the back panel 120 may initiate tearing of the first side panel 130 at the first side panel perforation 136, the front panel 110 and the front panel perforation 116, and/or the back panel 120 at the back panel perforation 126.

In some embodiments, the top portion 102 of the package 100 may be moved and/or translated away from the bottom portion 104 of the package 100. In some embodiments, moving the top end 112 of the front panel 110 and the top end 122 of the back panel 120 away from the bottom end 114 of the front panel 110 and the bottom end 124 of the back panel 120 adjacent the first side panel 130 may tear the front panel 110 at the front panel perforation 116 and may tear the back panel 120 at the back panel perforation 126. In some embodiments, a top portion 102 of the package 100 may be configured to pivot relative to a bottom portion 104 of the package 100 at the hinge element 146.

In some embodiments, an example package 100 may be formed from and/or otherwise include paper, paperboard, fiberboard, cardboard (including corrugated cardboard), polymer or plastic such as high-density polyethylene (HDPE), Mylar®, Tyvek®, polyester, etc., composites, and/or combinations thereof, as well as other suitable packaging materials known in the art, such as materials which permit sanitation of the contents of the package 100. In some embodiments, the example package 100 may include a plurality of layers, including layers of differing materials. Overall length, width, and/or depth of the example package 100 may be varied and/or adjusted as necessary to accommodate various products which may be contained therein.

Figure 2:
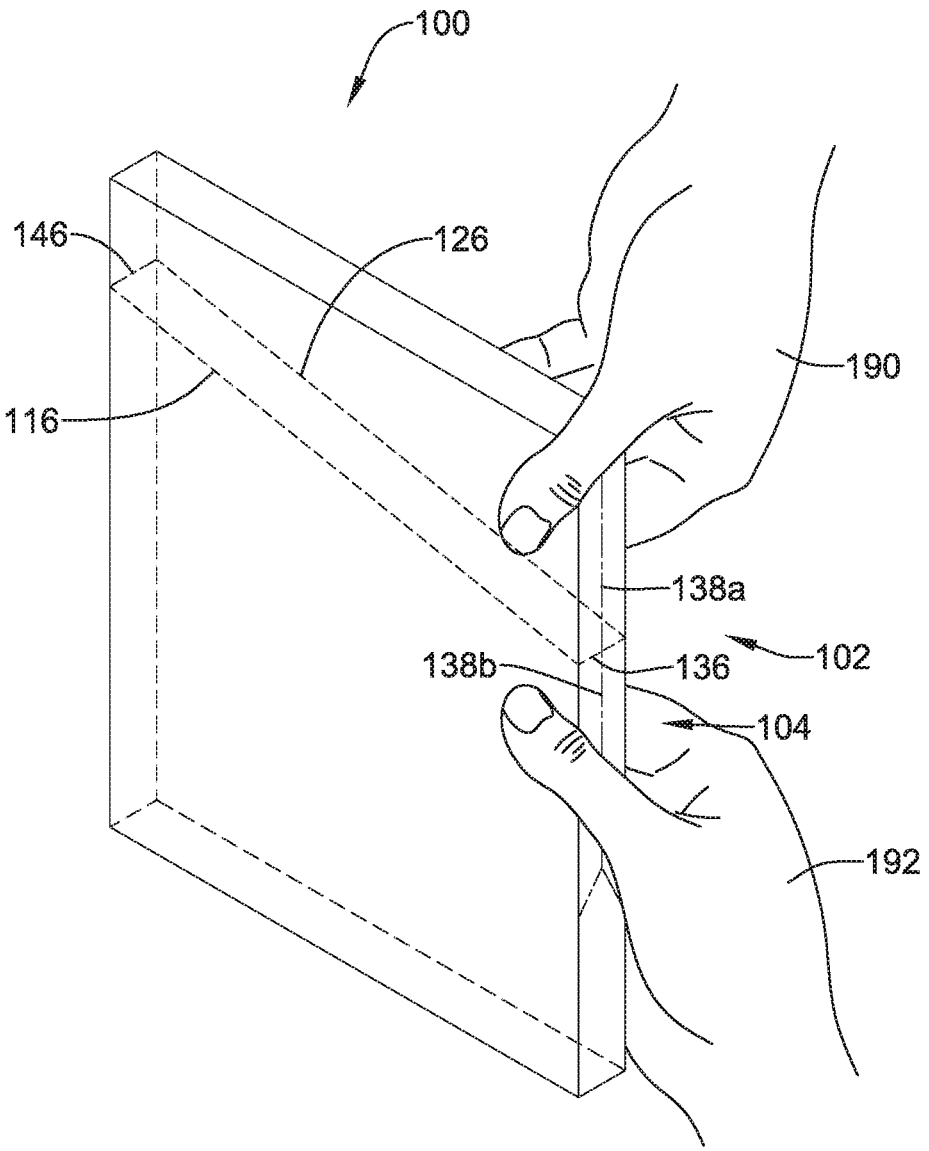
FIGS. 2-5 illustrate an example package and a method of opening the example package.

FIGS. 2-6 illustrate the general use of and a method of opening an example package 100 (e.g., a package for a medical device) having improved opening features as described herein. In some embodiments, a method of opening a package 100 may include one or more of the following steps:

Grasping a top portion 102 of the package 100 with a first hand 190 and a bottom portion 104 of the package 100 with a second hand 192, as seen in FIG. 2 for example, wherein the package 100 may include a front panel 110 and a back panel 120 opposite the front panel 110, the front panel 110 and the back panel 120 each including a top end, 112 and 122 respectively, and a bottom end, 114 and 124 respectively. In some embodiments, the package 100 may include a product or medical device (e.g., 198, FIG. 5) disposed within the package 100. In some embodiments, grasping the bottom portion 104 of the package 100 includes squeezing and/or pinching the product or medical device 198 disposed within the bottom portion 104 of the package 100 with the second hand 192.

The package 100 may include a first side panel 130 extending between the front panel 110 and the back panel 120, and a second side panel 140 extending between the front panel 110 and the back panel 120. The front panel 110 may include a front panel perforation 116 extending from the first side panel 130 to the second side panel 140, and the back panel 120 may include a back panel perforation 126 extending from the first side panel 130 to the second side panel 140. The first side panel 130 may include a first side panel perforation 136 extending from the front panel perforation 116 to the back panel perforation 126, a first weakened bend element 138*a* extending from the first side panel perforation 136 toward a top end of the first side panel 130, and/or a second weakened bend element 138*b* extending from the first side panel perforation 136 toward a bottom end of the first side panel 130. The second side panel 140 may include a hinge element 146 extending from the front panel perforation 116 to the back panel perforation 126.

Figure 3:
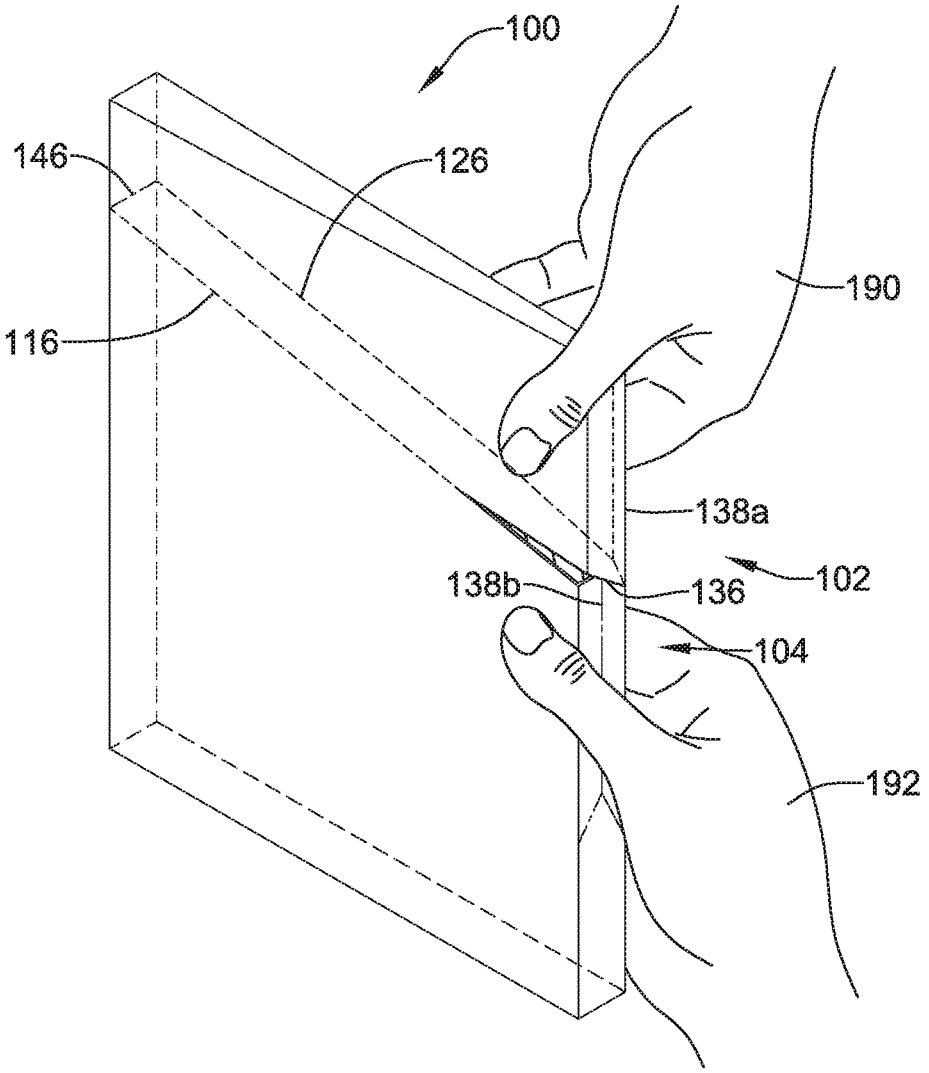
Figure 4:
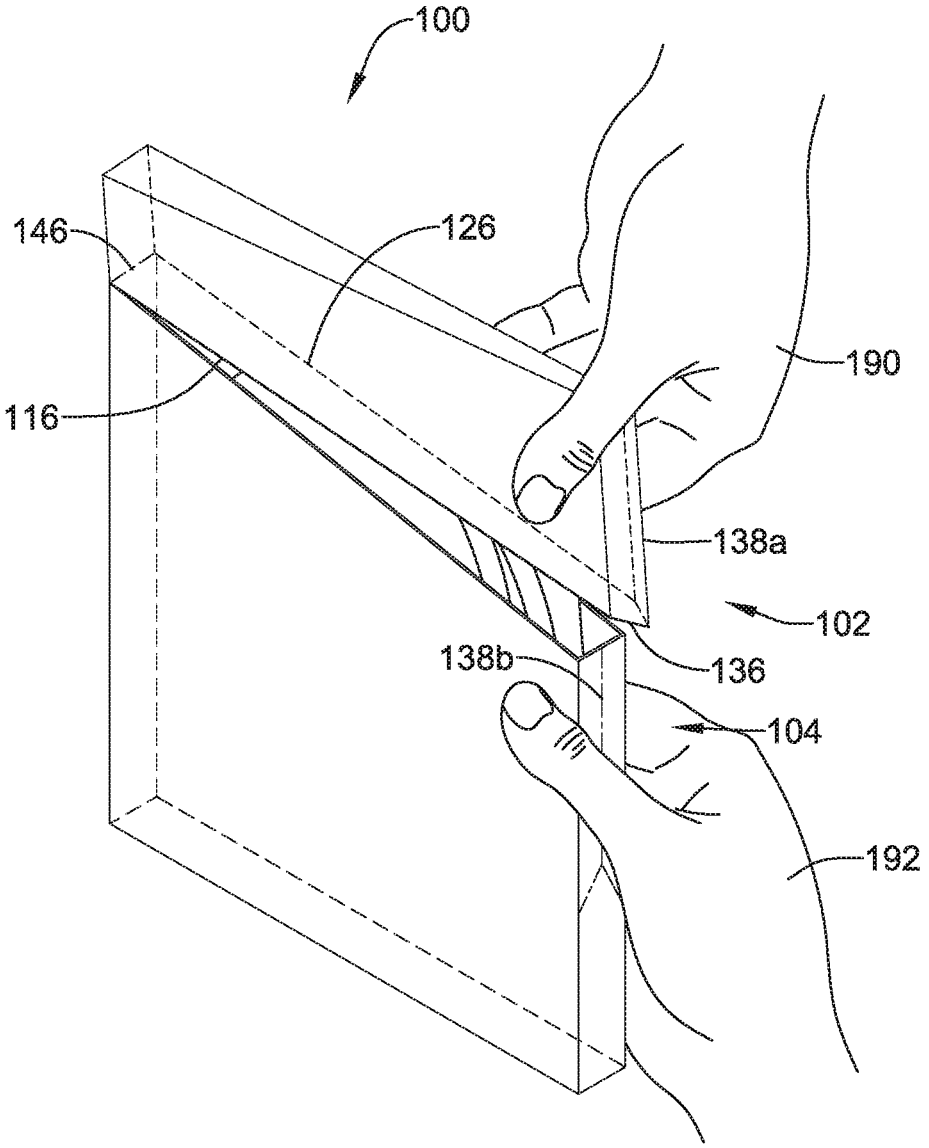

Squeezing the top portion 102 of the package 100 adjacent the front panel perforation 116 and the back panel perforation 126 with the first hand 190, thereby initiating separation of the top portion 102 of the package 100 from the bottom portion 104 of the package 100 adjacent the first side panel 130 and/or at the first side panel perforation 136, as seen in FIG. 3 for example. Squeezing the top portion 102 of the package 100 may bend and/or flex the first side panel 130 at the first weakened bend element 138*a*. In some embodiments, bending and/or flexing the first side panel 130 at the first weakened bend element 138*a* may cause tearing at/of the first side panel perforation 136. In some embodiments, separating the top portion 102 of the package 100 from the bottom portion 104 of the package 100 at the first side panel perforation 136 may include, be initiated by, and/or be made possible by tearing the first side panel perforation 136. In some embodiments, squeezing the bottom portion 104 of the package 100 may bend and/or flex the first side panel 130 at the second weakened bend element 138*b*. In some embodiments, bending and/or flexing the first side panel 130 at the second weakened bend element 138*b* may cause tearing at/of the first side panel perforation 136. Pulling the top portion 102 of the package 100 away from the bottom portion 104 of the package 100 to tear the front panel perforation 116 and the back panel perforation 126 from the first side panel 130 to the second side panel 140, as seen in FIG. 4 for example.

Figure 5:
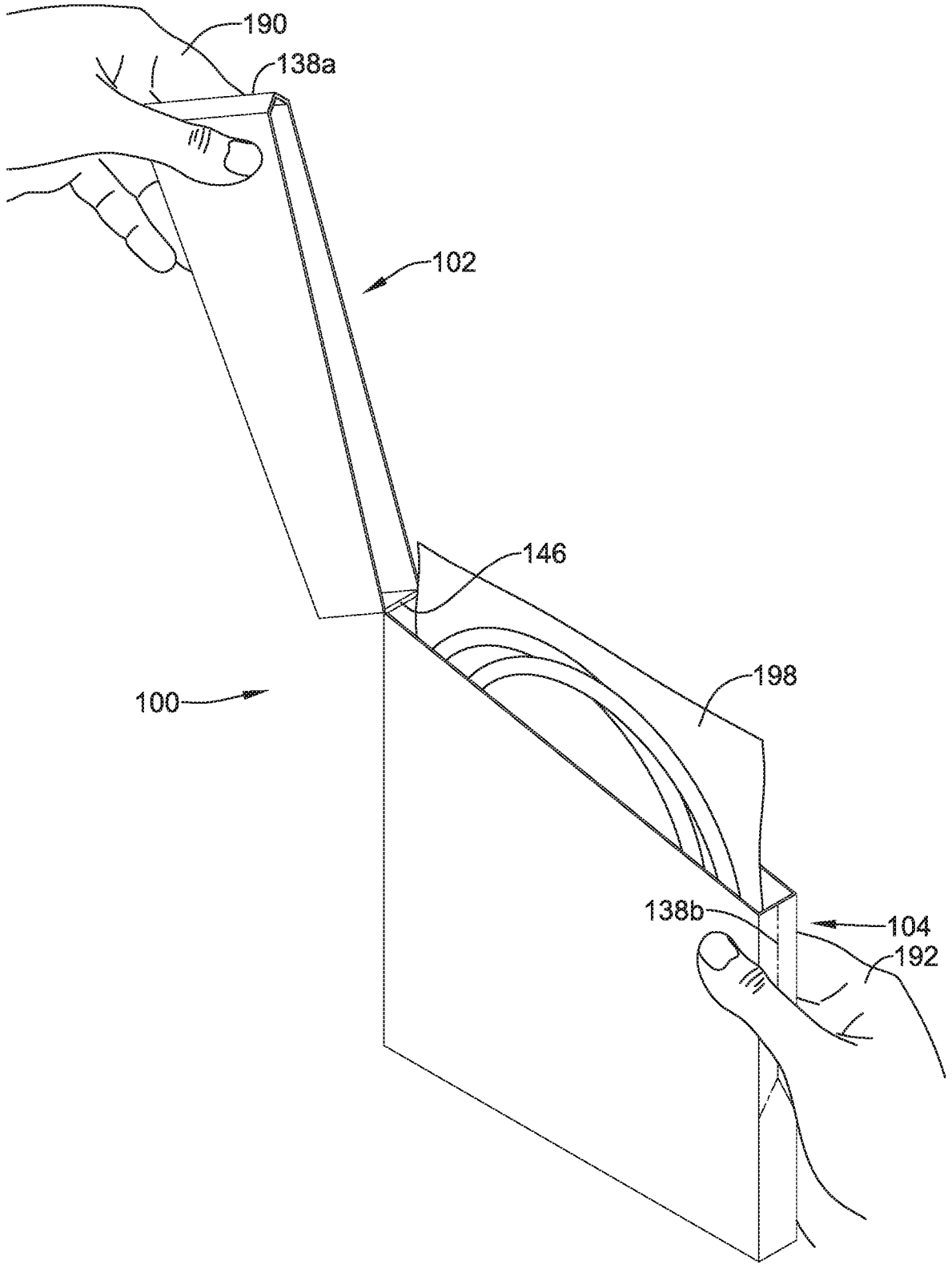

Rotating and/or pivoting the top portion 102 of the package 100 relative to the bottom portion 104 of the package 100 at the hinge element 146 with the first hand 190, as seen in FIG. 5 for example, to expose at least a portion of a product or medical device 198 disposed within the package 100. In some embodiments, squeezing and/or pinching the product or medical device 198 disposed within the bottom portion 104 of the package 100 with the second hand 192 may prevent the product and/or medical device 198 from being pulled out of the bottom portion 104 of the package 100 when the top portion 102 of the package 100 is rotated and/or pivoted relative to the bottom portion 104 of the package 100.

Figure 6:
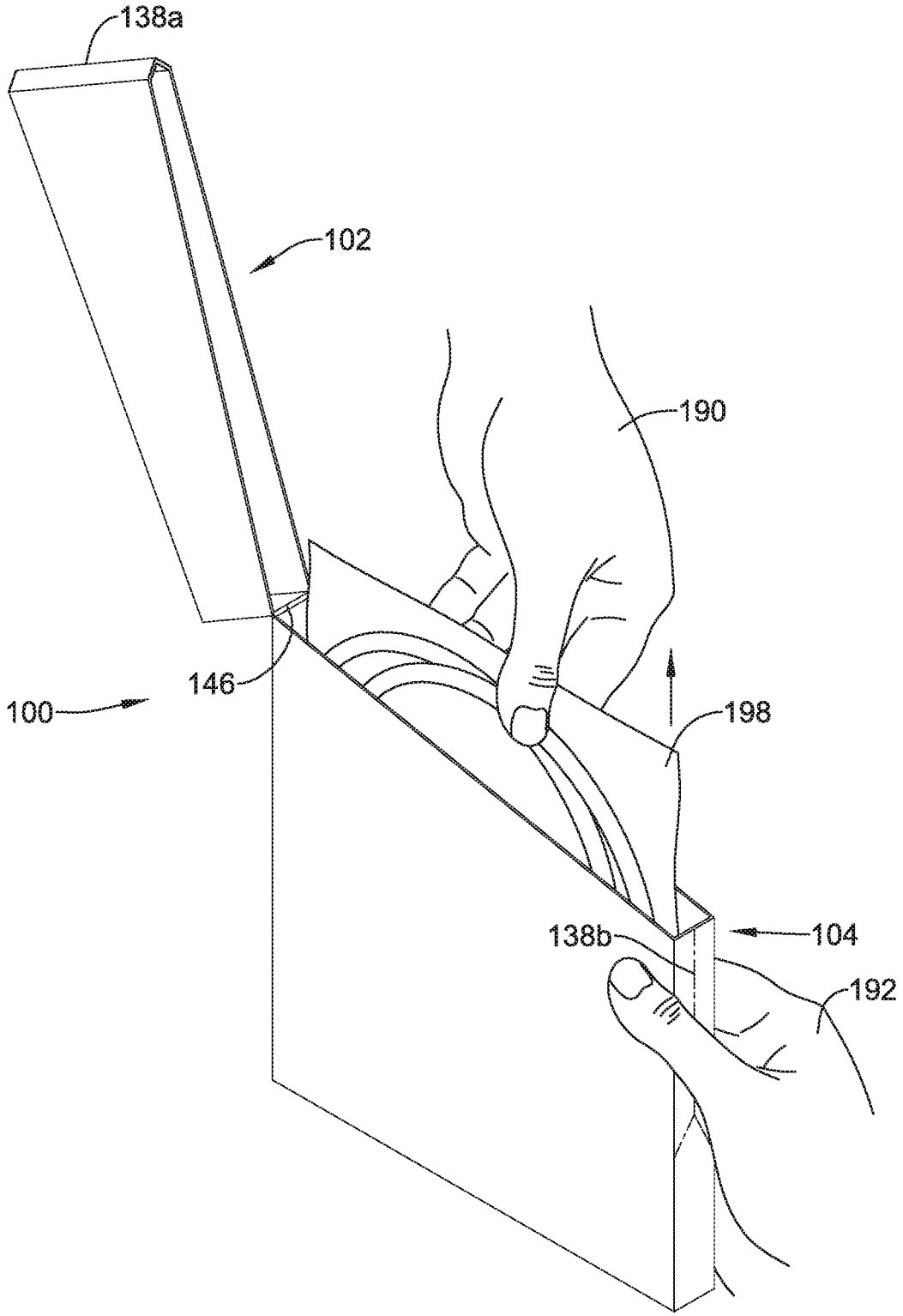
FIG. 6 illustrates removing an example product from an example package in accordance with the present disclosure.

Releasing the top portion 102 of the package 100 with the first hand 190 while continuing to grasp the bottom portion 104 of the package 100 with the second hand 192. Grasping the at least a portion of the product or medical device 198 with the first hand 190, relaxing the grasp on the bottom portion 104 and/or the product or medical device 198 with the second hand 192, and removing the product or medical device 198 from within the package 100 using the first hand 190 while maintaining the second hand 192 on the bottom portion 104 of the package 100 and/or without removing the second hand 192 from the bottom portion 104 of the package 100, as seen in FIG. 6 for example.

In some embodiments, squeezing the top portion 102 of the package 100 with the first hand 190 may bend the first side panel 130 at the first weakened bend element 138*a* disposed between the front panel 110 and the back panel 120 and/or squeezing the bottom portion 104 of the package 100 with the second hand 192 may bend the first side panel 130 at the second weakened bend element 138*b* disposed between the front panel 110 and the back panel 120. In some embodiments, squeezing the top portion 102 of the package 100 with the first hand 190 and/or the bottom portion 104 of the package 100 with the second hand 192 may tear the front panel perforation 116 and/or the back panel perforation 126 adjacent the first side panel 130.

In some embodiments, the top portion 102 of the package 100 and the bottom portion 104 of the package 100 are separated and/or defined by the front panel perforation 116, the back panel perforation 126, the first side panel perforation 136, and/or the hinge element 146. In some embodiments, the top portion 102 of the package 100 extends away from the top end 112 of the front panel 110, the top end 122 of the back panel 120, the top end 132 of the first side panel 130, and/or the top end 142 of the second side panel 140, and towards the bottom end 114 of the front panel 110, the bottom end 124 of the back panel 120, the bottom end 134 of the first side panel 130, and/or the bottom end 144 of the second side panel 140.

In some embodiments, the grasping, squeezing, pulling, and rotating steps may occur in one continuous motion. In some embodiments, the squeezing, pulling, and rotating steps may occur without removing the first hand 190 or the second hand 192 from the package 100.

It should be understood that this disclosure is, in many respects, only illustrative. Changes may be made in details, particularly in matters of shape, size, and arrangement of steps without exceeding the scope of the invention. This may include, to the extent that it is appropriate, the use of any of the features of one example embodiment being used in other embodiments. The invention's scope is, of course, defined in the language in which the appended claims are expressed.

What is claimed is:

1. A package for a medical device, comprising:

a front panel and a back panel opposite the front panel, the front panel and the back panel each including a top end and a bottom end;

a first side panel extending between the front panel and the back panel; and a second side panel extending between the front panel and the back panel opposite the first side panel;

wherein the front panel includes a front panel perforation extending from the first side panel to the second side panel, the front panel perforation being disposed between the top end of the front panel and the bottom end of the front panel;

wherein the back panel includes a back panel perforation extending from the first side panel to the second side panel, the back panel perforation being disposed between the top end of the back panel and the bottom end of the back panel;

wherein the first side panel includes a first side panel perforation extending from the front panel perforation to the back panel perforation;

wherein the second side panel includes a hinge element extending from the front panel perforation to the back panel perforation;

wherein the first side panel includes a first weakened bend element extending from the first side panel perforation toward a top end of the first side panel;

wherein the first side panel includes a second weakened bend element extending from the first side panel perforation toward a bottom end of the first side panel;

wherein the first weakened bend element extends substantially perpendicular to the first side panel perforation.

2. The package of claim 1, wherein the back panel perforation is substantially parallel with the front panel perforation.

3. The package of claim 1, wherein the hinge element includes a score line formed in the second side panel.

4. The package of claim 1, wherein the first weakened bend element includes a score line formed in the first side panel.

5. The package of claim 1, wherein displacement of the front panel toward the back panel adjacent the top ends thereof bends the first side panel at the first weakened bend element.

6. The package of claim 5, wherein displacement of the front panel toward the back panel adjacent the top ends thereof initiates tearing of the first side panel at the first side panel perforation.

7. The package of claim 6, wherein moving the top end of the front panel and the top end of the back panel away from the bottom end of the front panel and the bottom end of the back panel adjacent the first side panel tears the front panel at the front panel perforation and tears the back panel at the back panel perforation.

8. A method of opening a package for a medical device, comprising:

grasping a top portion of the package with a first hand and a bottom portion of the package with a second hand, the package comprising:

a front panel and a back panel opposite the front panel, the front panel and the back panel each including a top end and a bottom end;

a first side panel extending between the front panel and the back panel; and a second side panel extending between the front panel and the back panel opposite the first side panel;

wherein the front panel includes a front panel perforation extending from the first side panel to the second side panel and the back panel includes a back panel perforation extending from the first side panel to the second side panel;

wherein the first side panel includes a first side panel perforation extending from the front panel perforation to the back panel perforation;

wherein the second side panel includes a hinge element extending from the front panel perforation to the back panel perforation;

squeezing the top portion of the package adjacent the front panel perforation and the back panel perforation with the first hand, thereby initiating separation of the top portion from the bottom portion adjacent the first side panel;

wherein squeezing the top portion of the package bends the first side panel at a first weakened bend element disposed between the front panel and the back panel and at a second weakened bend element disposed between the front panel and the back panel;

wherein the first weakened bend element extends from the first side panel perforation toward a top end of the first side panel and the second weakened bend element extends from the first side panel perforation toward a bottom end of the first side panel;

wherein the first weakened bend element extends substantially perpendicular to the first side panel perforation;

pulling the top portion of the package away from the bottom portion of the package to tear the front panel perforation and the back panel perforation from the first side panel to the second side panel; and rotating the top portion at the hinge element with the first hand.

9. The method of claim 8, further comprising:

releasing the top portion with the first hand while continuing to grasp the bottom portion with the second hand;

removing the medical device from within the package using the first hand.

10. The method of claim 8, wherein the front panel perforation is disposed between the top end of the front panel and the bottom end of the front panel;

wherein the back panel perforation is disposed between the top end of the back panel and the bottom end of the back panel.

11. The method of claim 8, wherein squeezing the top portion of the package tears the front panel perforation and the back panel perforation adjacent the first side panel.

12. The method of claim 8, wherein the top portion of the package and the bottom portion of the package are separated by the front panel perforation and the back panel perforation.

13. The method of claim 8, wherein the top portion of the package extends away from the top end of the front panel and the top end of the back panel, and towards the bottom end of the front panel and the bottom end of the back panel.

14. The method of claim 8, wherein the grasping, squeezing, pulling, and rotating steps occur in one continuous motion.

15. The method of claim 8, wherein the squeezing, pulling, and rotating steps occur without removing either one of the first hand or the second hand from the package.

16. The method of claim 8, wherein grasping the bottom portion of the package includes pinching the medical device between the front panel and the back panel with the second hand.

* * * * *